US008342484B2

(12) United States Patent
Matos

(10) Patent No.: US 8,342,484 B2
(45) Date of Patent: Jan. 1, 2013

(54) ANCHOR WINDLASS FOR BOATS

(76) Inventor: Robert Matos, Clearwater, FL (US)

( * ) Notice: Subject to any disclaimer, the term of this patent is extended or adjusted under 35 U.S.C. 154(b) by 479 days.

(21) Appl. No.: 12/658,850

(22) Filed: Feb. 16, 2010

(65) Prior Publication Data

US 2011/0198547 A1 Aug. 18, 2011

(51) Int. Cl.
*B66D 1/395* (2006.01)

(52) U.S. Cl. ..... 254/383; 254/371

(58) Field of Classification Search ..... 254/383, 254/278, 371, 373
See application file for complete search history.

(56) References Cited

U.S. PATENT DOCUMENTS

| | | | | | |
|---|---|---|---|---|---|
| 398,502 | A | | 2/1889 | Dyblie | |
| 644,468 | A | | 2/1900 | Rutter | |
| 2,599,200 | A | | 6/1952 | Rogers | |
| 3,577,951 | A | | 5/1971 | Smith | |
| 3,603,561 | A | | 9/1971 | Davies | |
| 3,648,960 | A | * | 3/1972 | Krekeler | 254/116 |
| 3,658,299 | A | | 4/1972 | Sprague | |
| 3,774,562 | A | | 11/1973 | Dean | |
| 3,834,670 | A | | 9/1974 | Pityo | |
| 4,131,263 | A | * | 12/1978 | John | 254/8 B |
| 4,248,171 | A | | 2/1981 | Barbour | |
| 4,362,119 | A | | 12/1982 | Thimander | |
| 4,422,600 | A | * | 12/1983 | Preston | 242/271 |
| 5,402,985 | A | * | 4/1995 | Owens et al. | 254/333 |
| 5,996,524 | A | | 12/1999 | Johnson | |
| 5,996,971 | A | * | 12/1999 | Crouse | 254/371 |
| 6,098,962 | A | * | 8/2000 | Henly | 254/333 |
| 6,394,421 | B1 | * | 5/2002 | Henly | 254/365 |
| 6,490,988 | B2 | | 12/2002 | Caprioglio | |
| 6,572,082 | B1 | * | 6/2003 | Dixon et al. | 254/323 |
| 6,843,196 | B1 | | 1/2005 | Richardson | |
| 7,175,163 | B2 | * | 2/2007 | Blanc | 254/278 |
| 7,520,490 | B1 | * | 4/2009 | Lee | 254/372 |
| 7,562,862 | B1 | * | 7/2009 | Jackson | 254/376 |
| 7,571,895 | B2 | * | 8/2009 | Chiu | 254/372 |
| 7,644,907 | B2 | * | 1/2010 | Ives et al. | 254/278 |
| 2004/0149973 | A1 | * | 8/2004 | Chambers | 254/371 |
| 2004/0149974 | A1 | * | 8/2004 | Chambers | 254/371 |
| 2006/0231437 | A1 | | 10/2006 | Hull | |
| 2008/0245285 | A1 | | 10/2008 | Driscoll | |

* cited by examiner

*Primary Examiner* — Victor Batson
*Assistant Examiner* — Michael Gallion
(74) *Attorney, Agent, or Firm* — Andrew W. Ludy

(57) ABSTRACT

A windlass for a boat pulls in an anchor rode. A chainwheel mounted on a shaft has an annular groove to engage the anchor rode. A flexible retainer with a leaf spring is disposed across the chainwheel annular groove to press the rode into the chainwheel annular groove. The retainer has trunnions that pivot and slide transversely in upper and lower arcuate grooves, toward the slack portion of the rode. A housing is attached to a base and covers the rode for safety. The housing has the upper arcuate groove and an arcuate member has the lower arcuate groove. The base, housing, and arcuate member are aligned with three key members that engage one another. The rode slides on a low friction wear plate attached to the base. A funnel with a mouth facing forward is mounted on the base for directing the rode downward through a nozzle into the boat. A motor drive has an electric motor and a worm gear transmission attached to the shaft lower end for rotating the shaft.

19 Claims, 12 Drawing Sheets

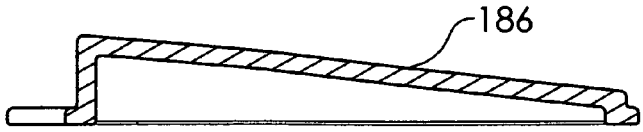
FIG. 16
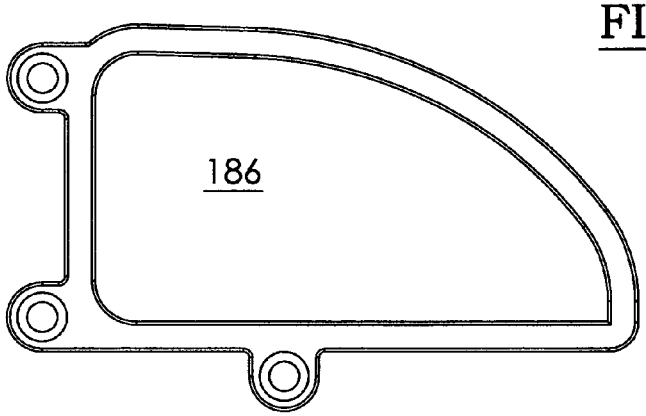
16 FIG. 15 16
18
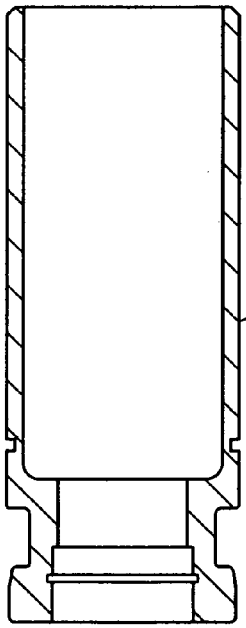
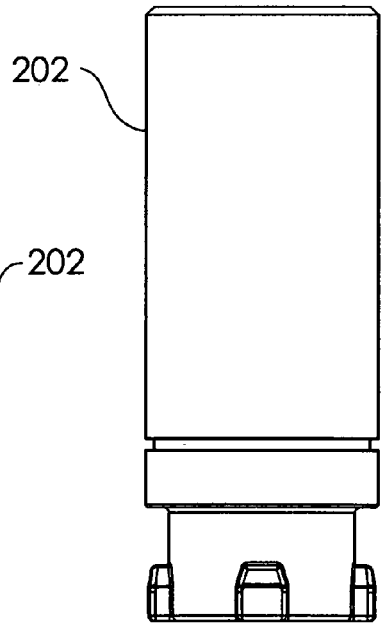
FIG. 18
18
FIG. 17

ANCHOR WINDLASS FOR BOATS

CROSS-REFERENCE TO RELATED APPLICATIONS

Reference is hereby made to provisional patent application titled, "Windlass;" filed by Robert Matos, of Sunrise, Fla., on Jan. 15, 2009, Ser. No. 61/144,773. The prior application is expressly incorporated herein by reference.

STATEMENT REGARDING FEDERALLY SPONSORED RESEARCH OR DEVELOPMENT

Not Applicable

BACKGROUND OF THE INVENTION

This invention relates to the field of winches, and more particularly to a windlass for raising and lowering a boat anchor.

A typical boat anchoring system includes a rode, which is a rope connected to a chain. The rode is attached to the anchor. A windlass pulls the rode to raise the anchor, and pays out the rode to lower the anchor. A typical windlass has a chainwheel, which is a sheave configured to grip both the rope and the chain. A pressure finger pivots at one end and is spring loaded against the rode. The pressure finger keeps the rode from slipping off the chainwheel. However, the pressure finger does a poor job of retaining the rode on the chainwheel. The pressure finger abrades the rope, and often allows the rope or chain to climb out of the chainwheel, fouling or jamming or damaging the rode. The rode can impact the tensioning mechanism and damage the swivel pin, which is used to guide the rode into the anchor chain locker. Conventional windlasses can allow the rode to drag across the ocean floor, becoming abraded and swollen. The rode is then no longer uniform in size and surface texture, and can run off the chainwheel or break, resulting in injury to a crewmember. The rode winding around an open or partly enclosed chainwheel can trap and injure fingers, hands, and feet.

Accordingly, there is a need to provide an anchor windlass for boats that can guide the rode surely and consistently onto the chainwheel, and prevent the rode from climbing or slipping off the chainwheel.

There is a further need to provide an anchor windlass of the type described and that will not damage, abrade, or break the rode.

There is a yet further need to provide an anchor windlass of the type described and that will safely haul the anchor without endangering the crew.

There is a still further need to provide an anchor windlass of the type described and that will guide the rode into the chain locker without fouling.

There is another need to provide an anchor windlass of the type described and that can be manufactured cost-effectively in large quantities of high quality.

BRIEF SUMMARY OF THE INVENTION

In accordance with the present invention, there is provided a windlass 70 for use in connection with a boat and an anchor (not shown), and a rode 72. The rode 72 has a tensioned portion, and a slack portion.

A base 74 has at least one aperture 88 therethrough adjacent the base rear end 78. The base 74 has a shaft hole 90 therethrough. The base bottom surface 86 is attached to the boat by studs 92 and a clamping ring 94.

A shaft 96 is mounted to the base 74 for rotation, and has threads 102 on the upper end 98.

A chainwheel 104 is mounted on the shaft 96 for rotation therewith. The chainwheel 104 has an annular groove 108 around an outer periphery 106 to engage the rode 72. The chainwheel 104 has an upper portion 106 and an opposite lower portion 108 spaced apart from the upper portion; the portions are joined for rotation in unison. A sleeve 110 concentric with the shaft 96 is disposed between the chainwheel upper 106 and lower 108 portions.

Upper 112 and lower 114 clutch disks are keyed for rotation with the shaft 96. The clutch disks frictionally engage the chainwheel upper portion 106 and lower portion 108 so as to transmit torque from the shaft 96 to the chainwheel 104. A nut 116 on the shall upper end 98 retains the clutch disks 112 and 114 and the chainwheel 104 on the shaft.

A stripper plate 118 has a proximal end 120 encircling the sleeve 110 and extending rearward to a distal end 122 attached to the base 74.

A flexible retainer 124 extends between opposite left 126 and right 128 ends, and is attached to the windlass 70 adjacent the base front end 76. The retainer has a right trunnion 130 extending between opposite upper 132 and lower 134 ends. The retainer 124 has a left trunnion 136 extending between opposite upper 138 and lower 140 ends. The retainer 124 is disposed across the chainwheel annular groove 108, and serves to press the rode 72 into the chainwheel annular groove 108. This will ensure that the rode 72 is retained on the chainwheel 104. The retainer 124 has a front surface 142 and an opposite rear surface 144. The retainer rear surface 144 has corrugations 146 for contact with the rode 72. A right pin 148 extends downward through the right trunnion 130. A left pin 150 extends downward through the left trunnion 136, to strengthen the trunnion.

A leaf spring 152 is mounted coextensively on the retainer 124 for biasing the retainer 124 against the rode 72. The retainer 124 has a right pocket 158 adjacent the right end 128 for receiving the leaf spring right end 156. The retainer 124 has a left pocket 160 adjacent the left end 126 for receiving the leaf spring left end 154. The pockets 158 and 160 will hold the leaf spring 152 closely adjacent the retainer front surface 142, while allowing the leaf spring 152 to flex with the retainer 124.

A housing 162 is attached to the base 74 and covers the chainwheel 104, the shaft upper end 98, and the retainer 124. The housing 162 is adapted to cover the rode 72 for safety. The housing 162 has an arcuate upper groove 165 on the inner surface 172 adjacent the front end 164. The upper groove 165 faces downward and extends across the housing 162 from the left side 168 to the right side 170.

An arcuate member 176 extends across the housing 162 from the left side 168 to the right side 170. The arcuate member 176 has an arcuate lower groove 178 facing upward and extending across the housing 162 opposite and coextensive with the upper groove 165. The trunnion upper ends are received in the upper groove 165. The trunnion lower ends are received in the lower groove 178. This allows the trunnions 130 and 136 to pivot in the grooves 165 and 178 as the retainer 124 flexes. This also allows the trunnions 130 and 136 to slide in the grooves 165 and 178 toward the slack portion of the rode 72, so that the retainer 124 will conform closely to the rode 72. The corrugations 146 cause the retainer 124 to slide transversely in the grooves 165 and 178.

The base 74 has two first key members 180 adjacent the base front end 76. The housing 162 has two second key members 182 adjacent the front end 164. The arcuate member 176 has two third key members 184 adjacent the housing front end 164. The key members engage one another so as to align the base 74, the housing 162, and the arcuate member 176.

A low friction wear plate 186 is attached to the base 74 adjacent the rear end 78, and is adapted for sliding contact with the rode 72

A funnel 188 has a mouth 190 facing forward, and a nozzle 192 extending downward and communicating with the mouth 190. The funnel 188 is mounted on the base aperture 88, for directing the rode 72 downward into the boat.

A motor drive 194 having an electric motor 196 and a worm gear transmission 198 is attached to the shaft lower end 100 for rotating the shaft 96.

BRIEF DESCRIPTION OF THE SEVERAL VIEWS OF THE DRAWING

A more complete understanding of the present invention may be obtained from consideration of the following description in conjunction with the drawing, in which:

FIG. 15 is a top plan view of the wear plate of the windlass of FIG. 1.

FIG. 16 is a right side sectional elevational view of the wear plate of FIG. 15, taken along lines 16-16 of FIG. 15.

FIG. 17 is a front elevational view of the shaft support of the windlass of FIG. 1.

FIG. 18 is a right side sectional elevational view of the shaft support of FIG. 17, taken along lines 18-18 of FIG. 17.

FIG. 39 is a top plan view of the windlass of FIG. 1, with the housing and chainwheel upper portion removed, showing the retainer and the rode winding in.

DETAILED DESCRIPTION OF THE INVENTION

Figure 1:
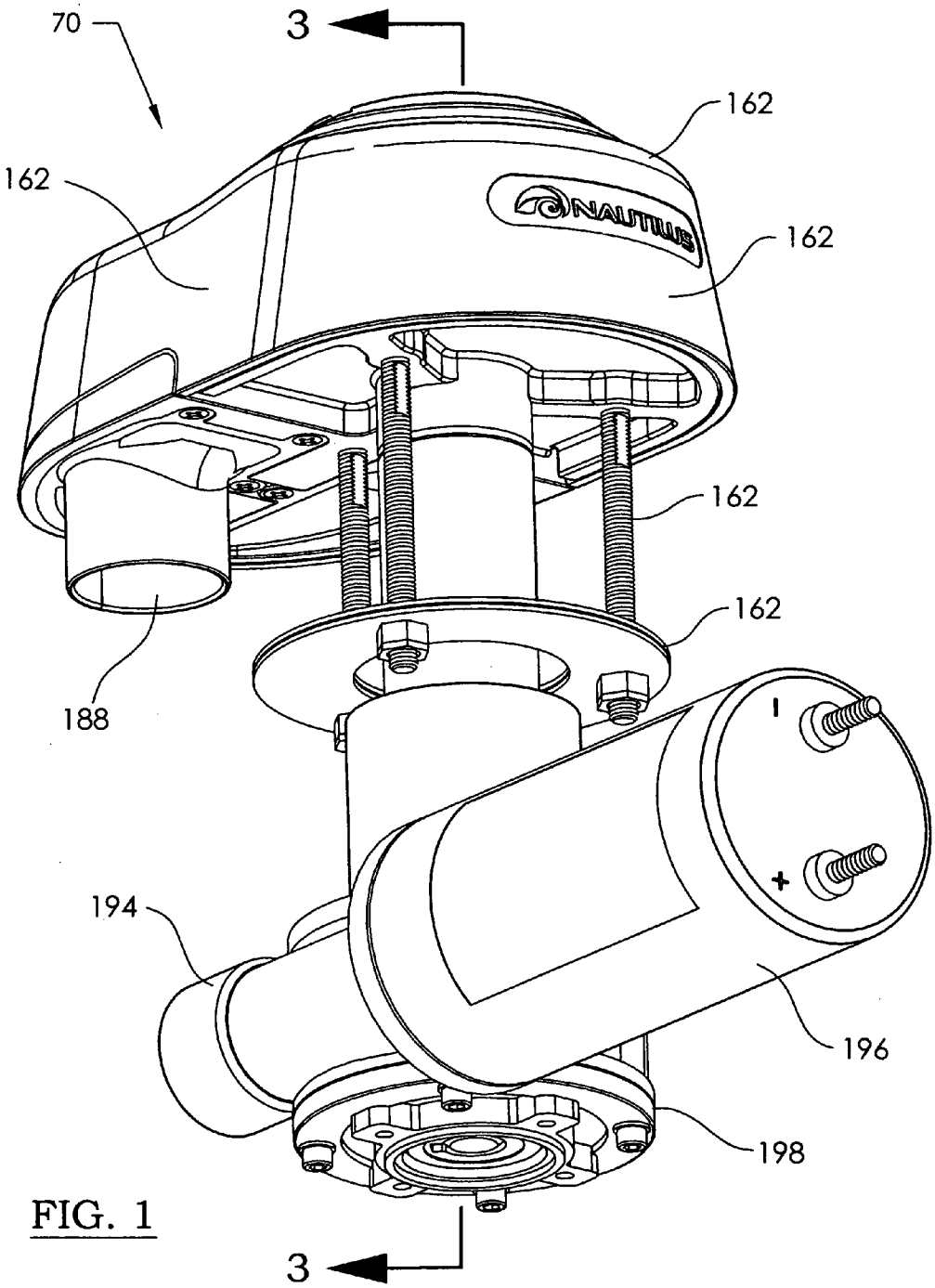
FIG. 1 is a perspective view of a windlass constructed in accordance with the invention.
Figure 2:
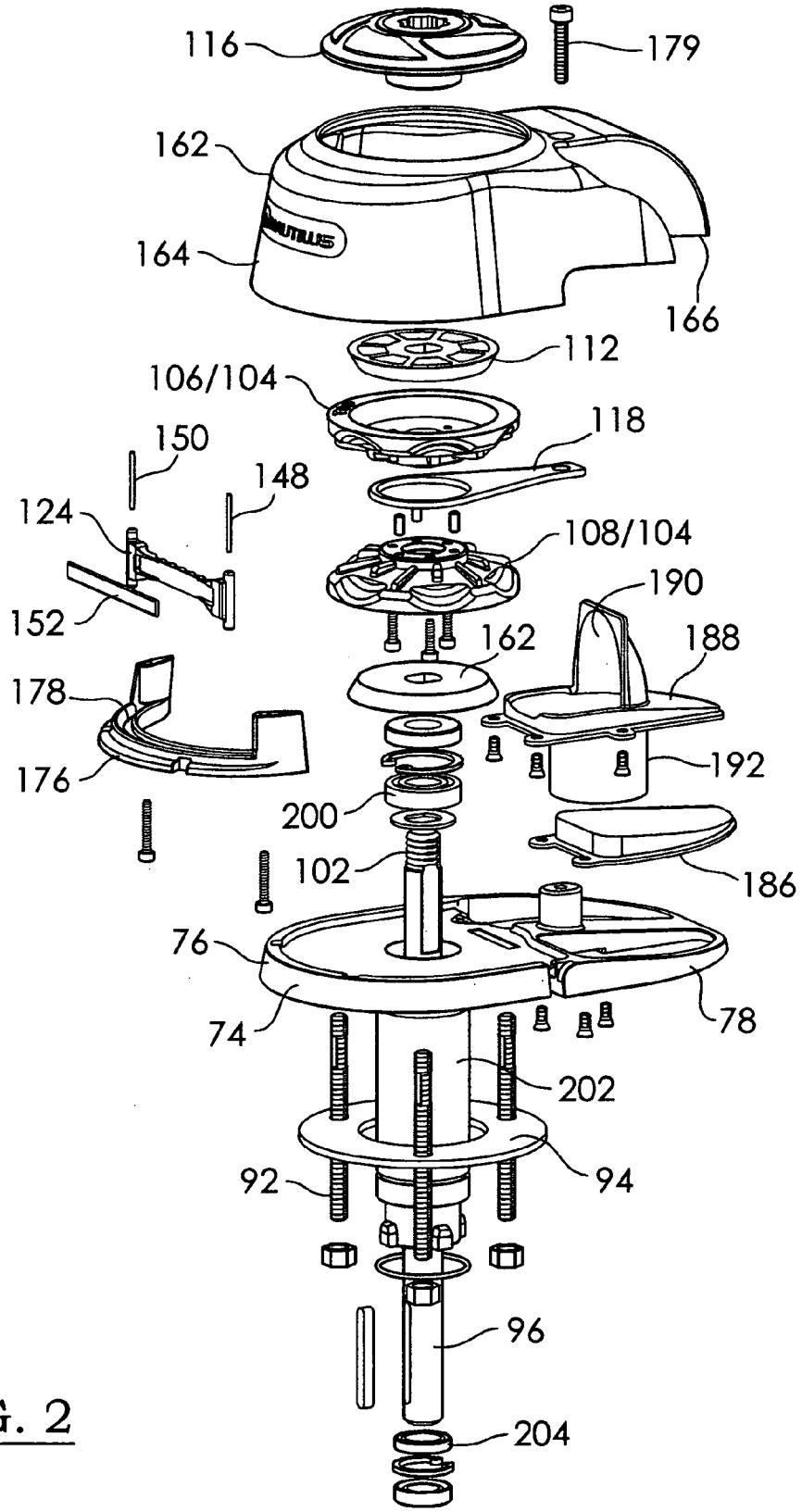
FIG. 2 is an exploded assembly perspective view of the windlass of FIG. 1.
Figure 3:
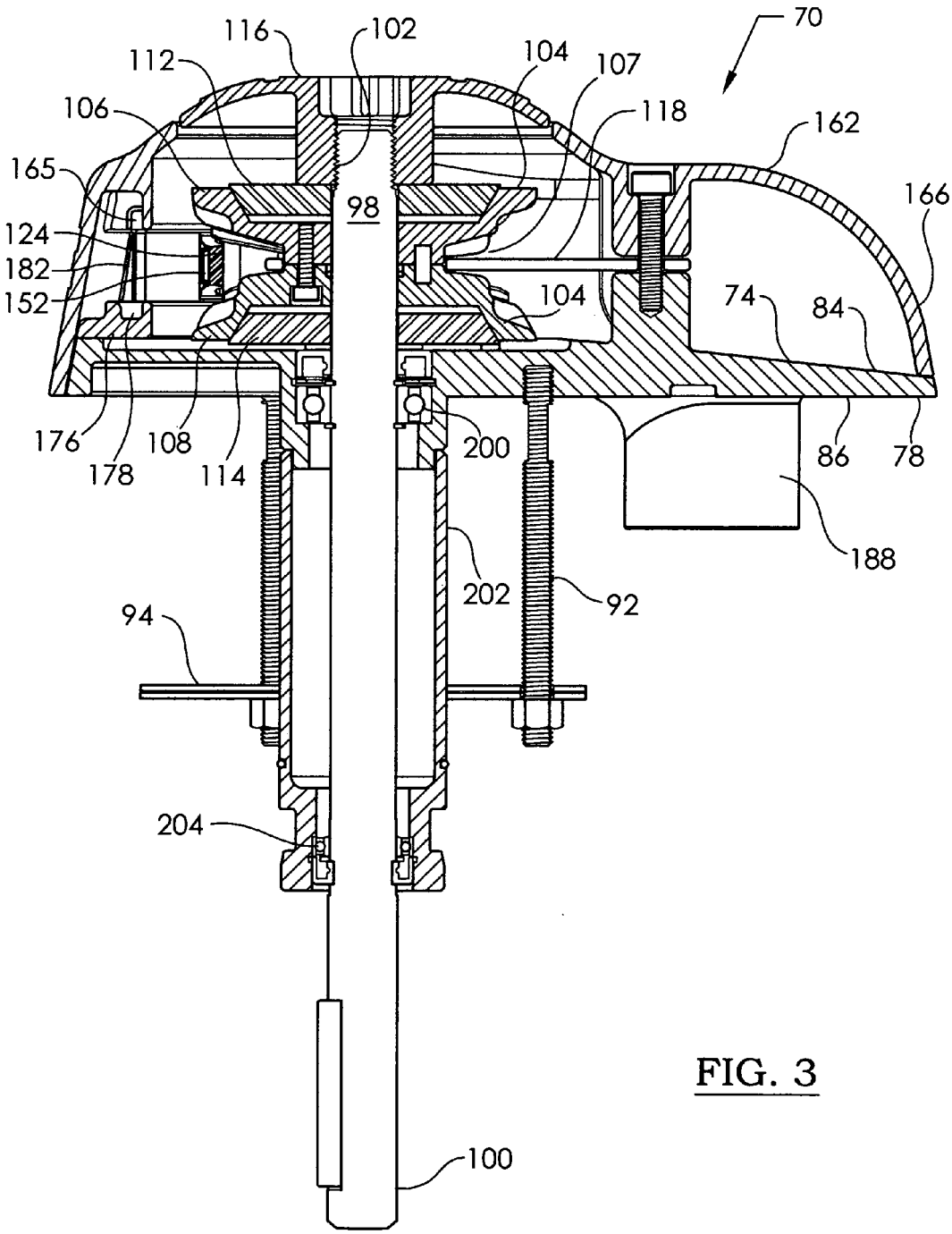
FIG. 3 is a right side sectional view of the windlass of FIG. 1, taken along lines 3-3 of FIG. 1.
Figure 4:
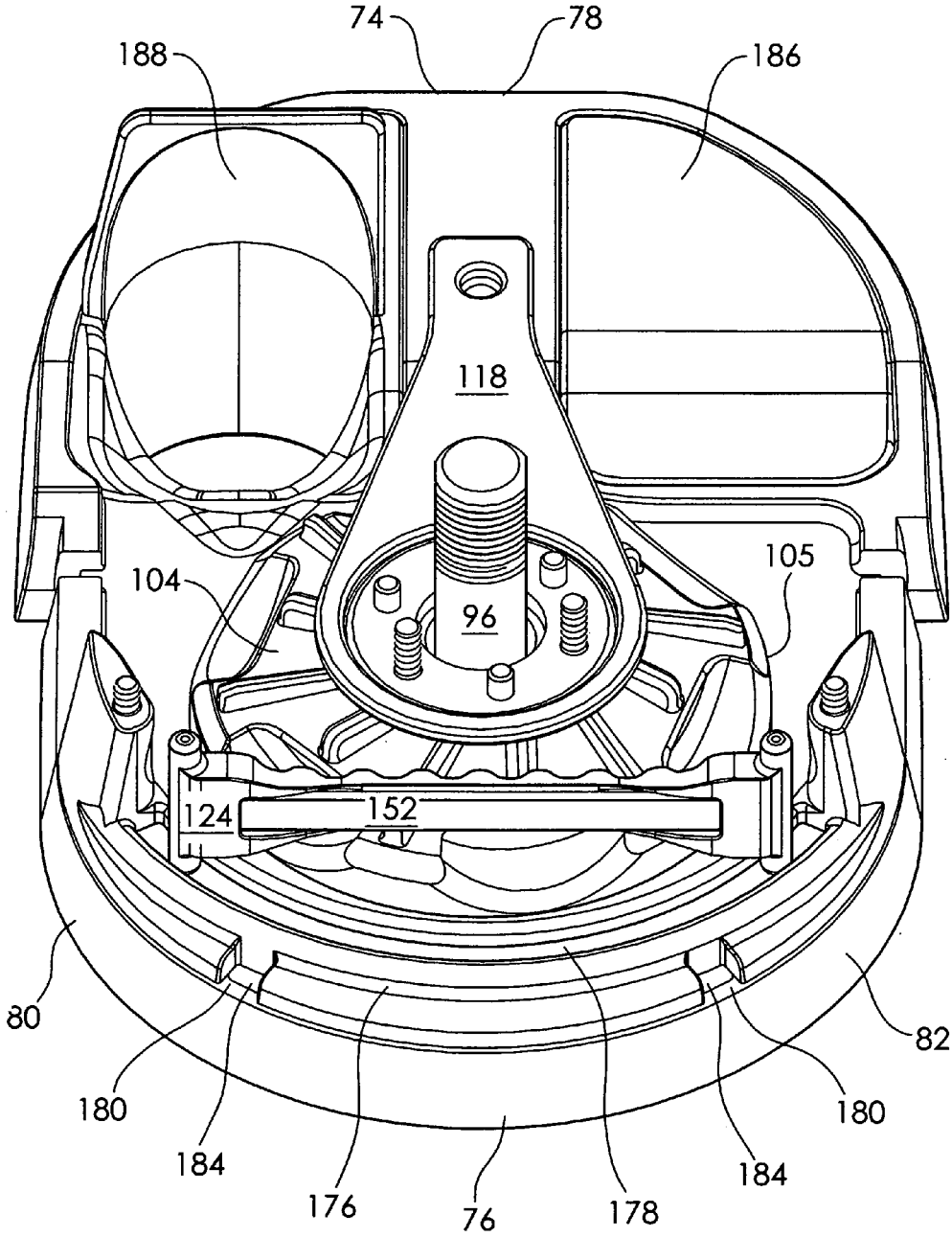
FIG. 4 is a front perspective view of the windlass of FIG. 1, with the housing and chainwheel upper portion removed.
Figure 6:
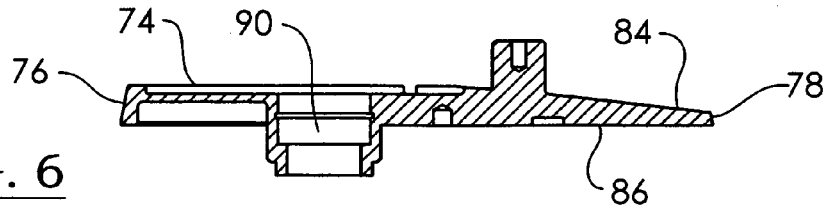
FIG. 6 is a sectional view of the base of FIG. 5, taken along lines 6-6 of FIG. 5.
Figure 5:
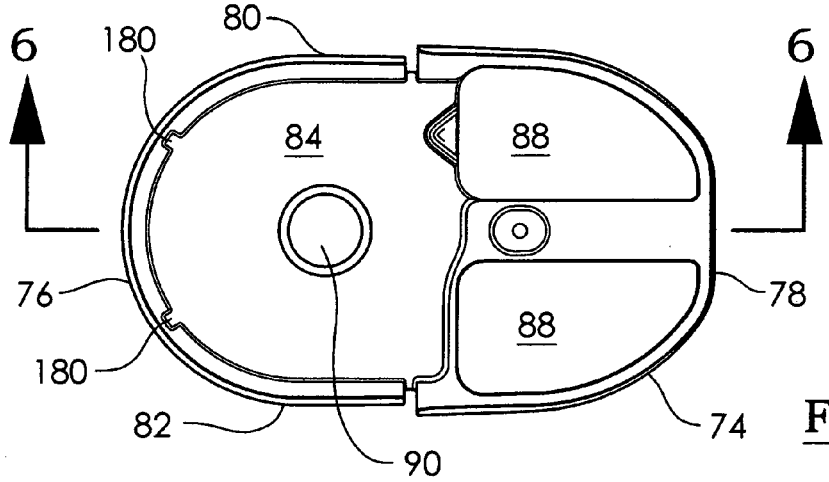
FIG. 5 is a top plan view of the base of the windlass of FIG. 1.
Figure 8:
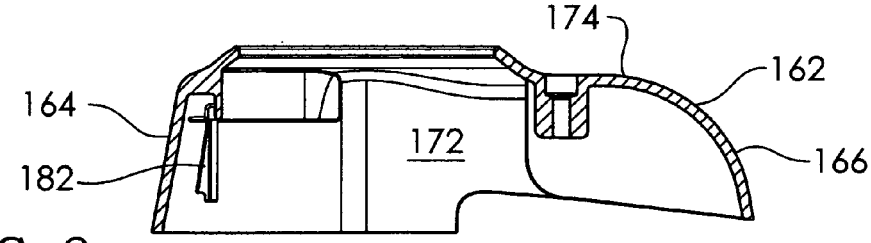
FIG. 8 is a sectional view of the housing of the windlass of FIG. 1, taken along lines 8-8 of FIG. 7.
Figure 7:
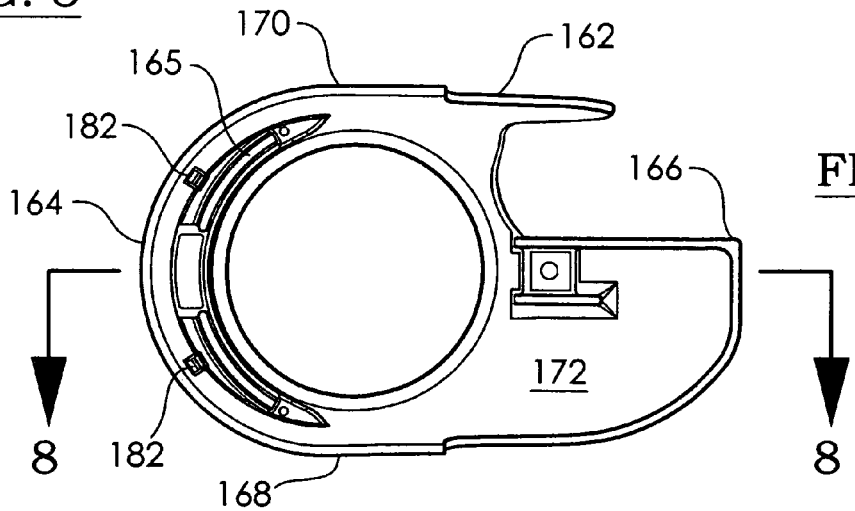
FIG. 7 is a bottom view of the housing of the windlass of FIG. 1.
Figure 9:
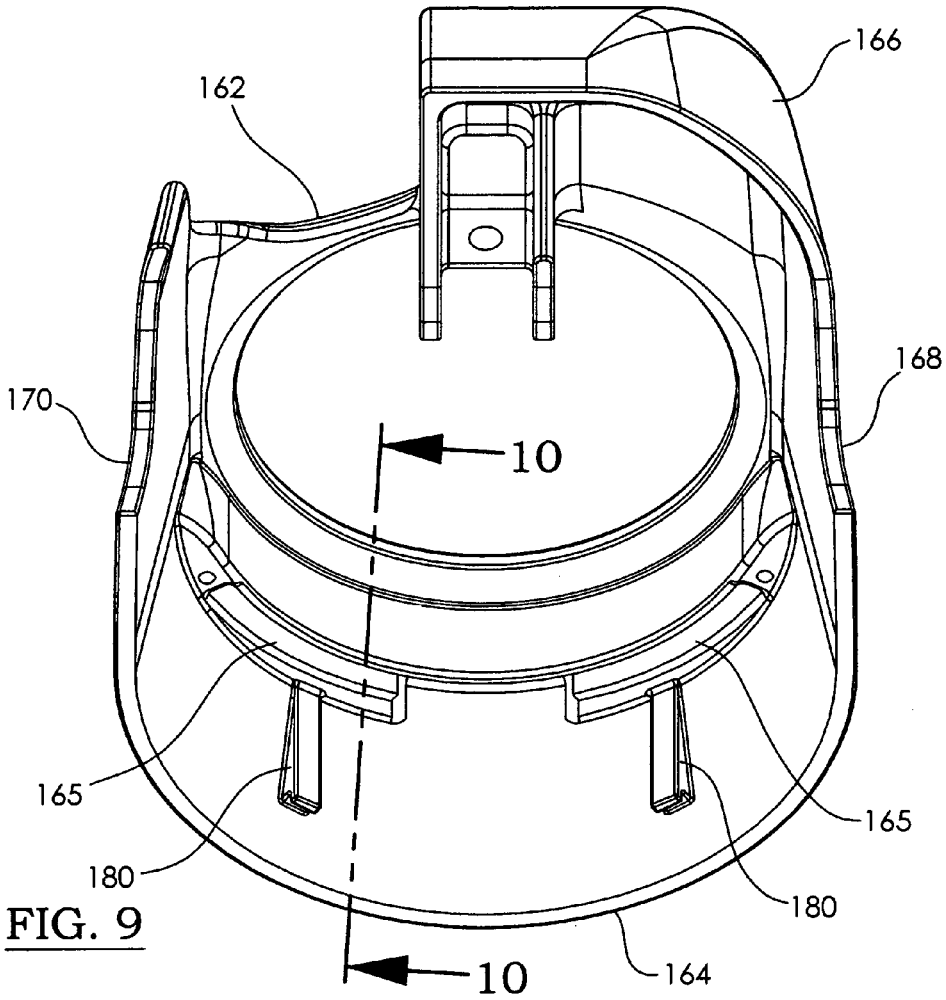
FIG. 9 is a bottom perspective view of the housing of FIG. 7.
Figure 10:
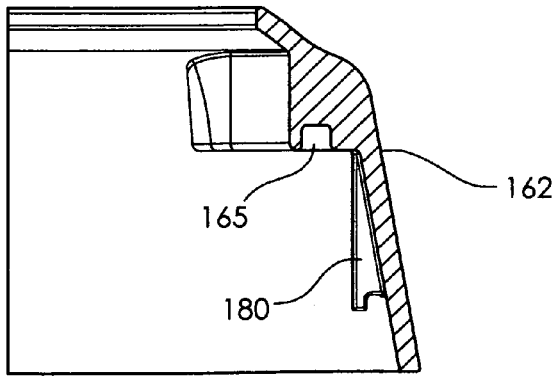
FIG. 10 is a sectional view of the housing of FIG. 7, taken along lines 10-10 of FIG. 9.
Figure 11:
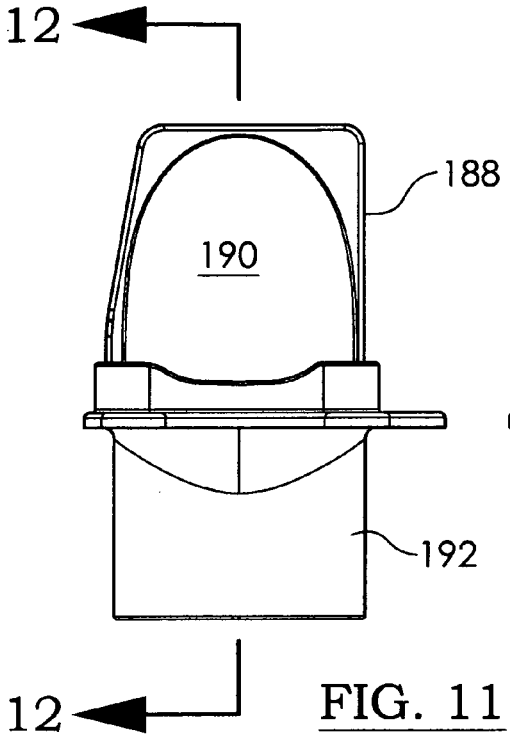
FIG. 11 is a front elevational view of the funnel of the windlass of FIG. 1.
Figure 12:
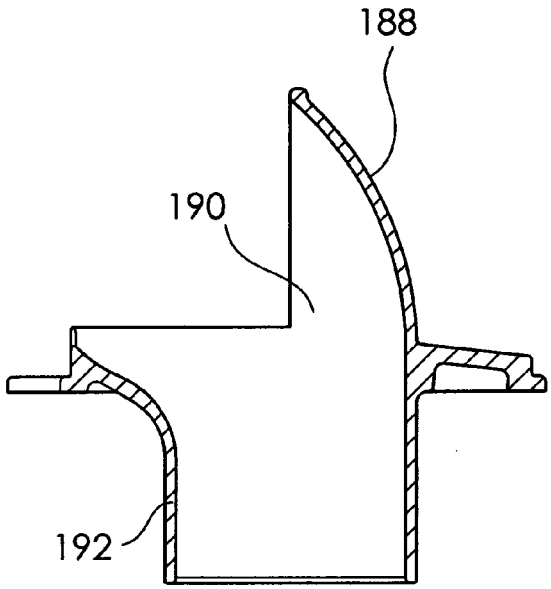
FIG. 12 is a right side sectional elevational view of the funnel of FIG. 11, taken along lines 12-12 of FIG. 11.
Figure 14:
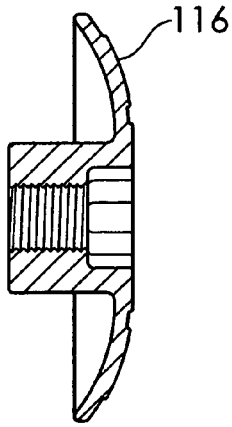
FIG. 14 is a sectional view of the nut of FIG. 13, taken along lines 14-14 of FIG. 13.
Figure 13:
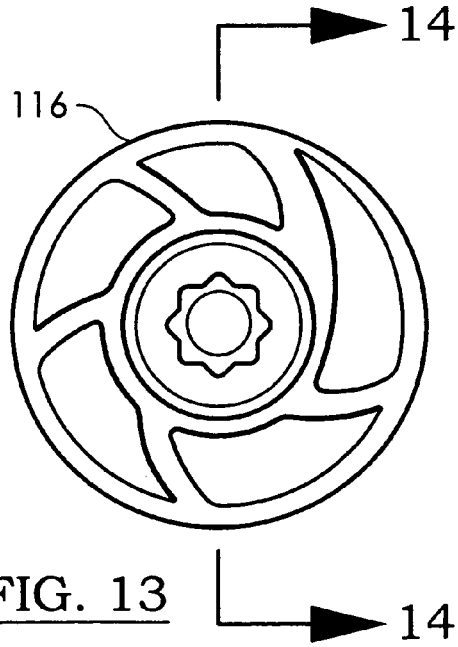
FIG. 13 is a top plan view of the nut of the windlass of FIG. 1.
Figure 19:
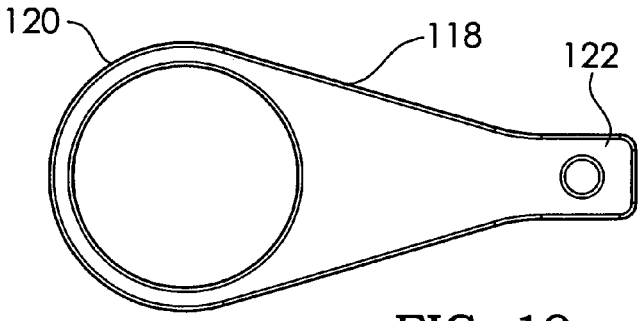
FIG. 19 is a top view of the stripper plate of the windlass of FIG. 1.
Figure 20:
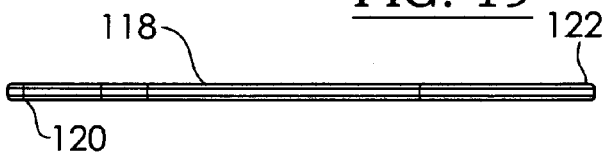
FIG. 20 is a right side elevational view of the stripper plate of FIG. 19.
Figures 21, 22:
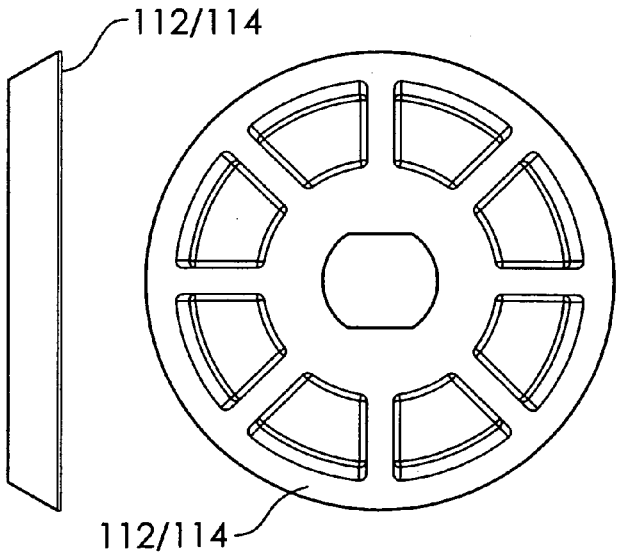
FIG. 21 is a top view of the upper clutch disk of the windlass of FIG. 1.
FIG. 22 is a side view of the upper clutch disk of FIG. 21.
Figure 23:
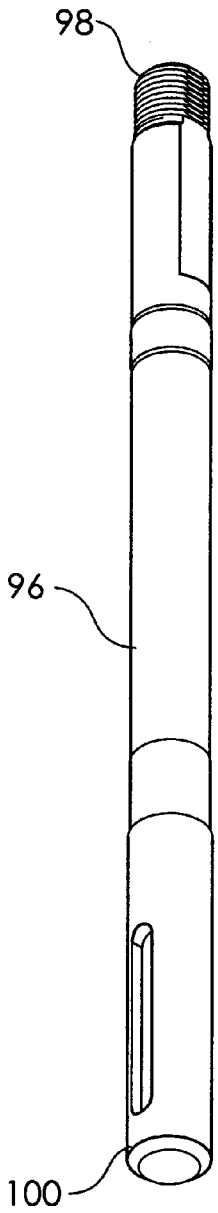
FIG. 23 is a side elevational view of the shaft of the windlass of FIG. 1.
Figure 24:
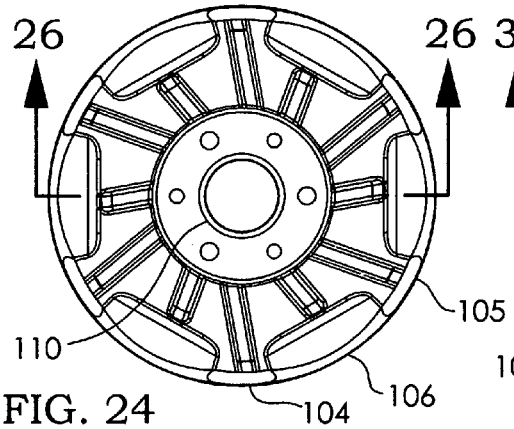
FIG. 24 is a bottom view of the chainwheel upper portion of the windlass of FIG. 1.
Figure 28:
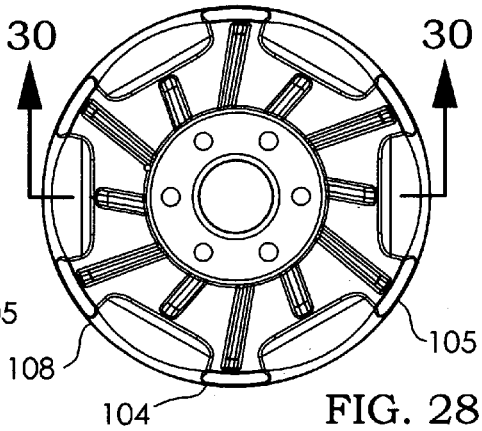
FIG. 28 is a top view of the chainwheel lower portion of the windlass of FIG. 1.
Figure 25:
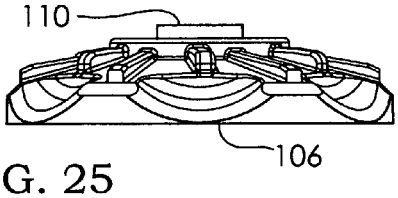
FIG. 25 is an inverted side elevational view of the chainwheel of FIG. 24.
Figure 29:
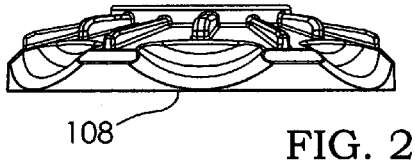
FIG. 29 is a side elevational view of the chainwheel of FIG. 28.
Figure 26:
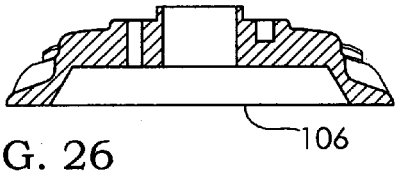
FIG. 26 is a sectional elevational view of the chainwheel of FIG. 24, taken along lines 26-26 of FIG. 24.
Figure 30:
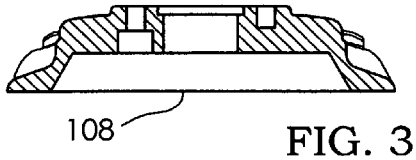
FIG. 30 is a sectional elevational view of the chainwheel of FIG. 28, taken along lines 30-30 of FIG. 28.
Figure 27:
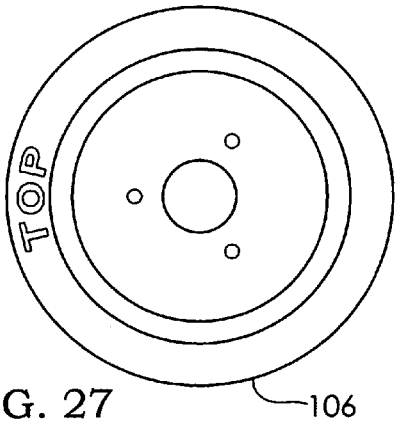
FIG. 27 is a top view of the chainwheel of FIG. 24.
Figure 31:
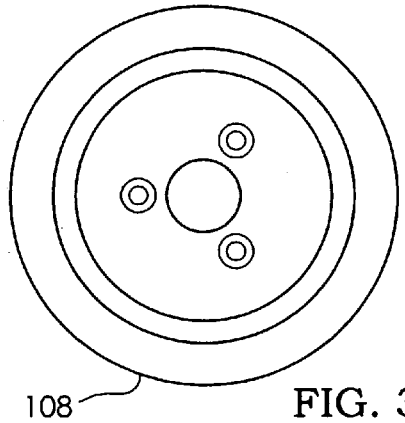
FIG. 31 is a bottom view of the chainwheel of FIG. 28.
Figure 33:
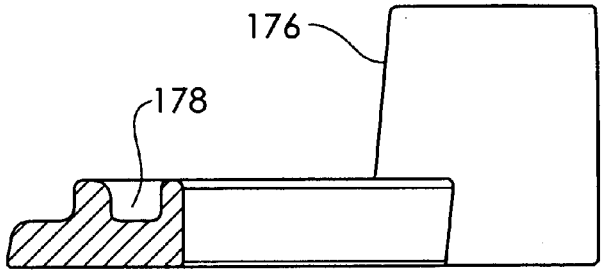
FIG. 33 is a right side sectional view of the arcuate member of FIG. 32, taken along lines 33-33 of FIG. 32.
Figure 32:
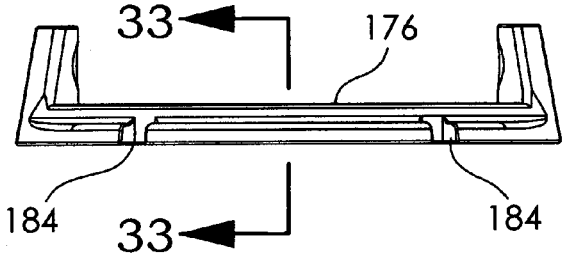
FIG. 32 is a front view of the arcuate member of the windlass of FIG. 1.
Figures 34, 35, 36, 37, 38:
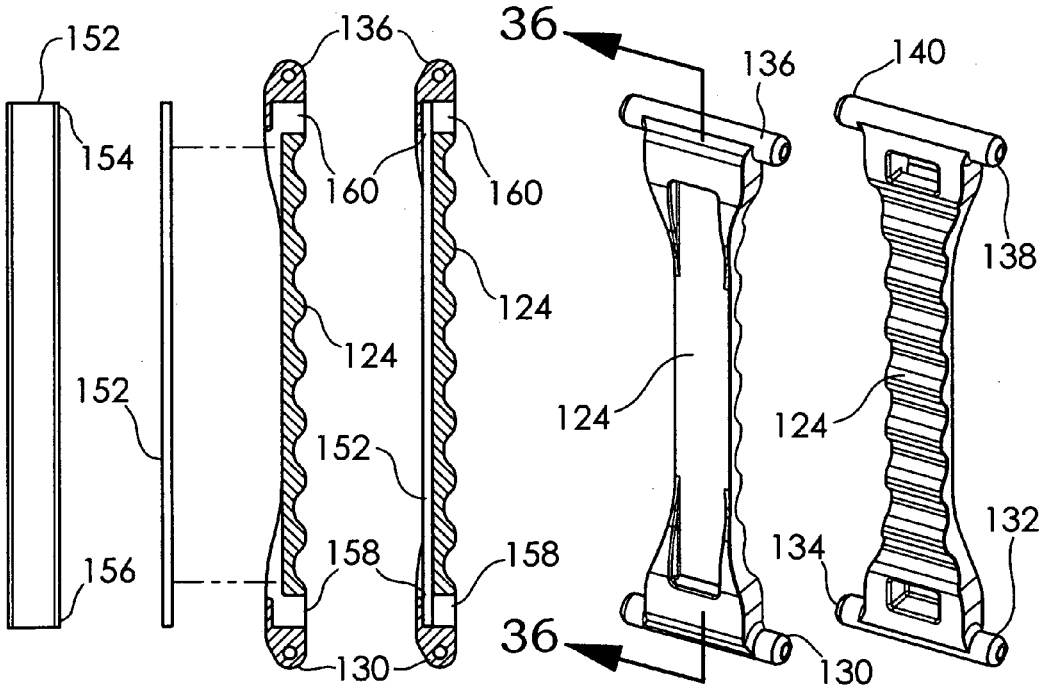
FIG. 34 is a front view of the retainer of the windlass of FIG. 1, rotated 90°.
FIG. 35 is a rear view of the retainer of FIG. 34.
FIG. 36 is a sectional view of the retainer of FIG. 34, taken along lines 36-36 of FIG. 34, and showing the leaf spring installed in the retainer.
FIG. 37 is a sectional view of the retainer of FIG. 34, taken along lines 36-36 of FIG. 34, and showing the leaf spring ready to install in the retainer.
FIG. 38 is a front view of the leaf spring, rotated 90°.

Referring now to the drawing, a windlass is shown at 70 and is for use in connection with a boat and an anchor (not shown), and a rode 72. The rode 72 has a tensioned portion entering the windlass as the anchor is hauled up, and a slack portion exiting the windlass into the chain locker. The tensioned and slack portions can reverse as the windlass direction reverses.

A base 74 extends between opposite front 76 and rear 78 ends, and between opposite left 80 and right 82 sides, and between opposite top 84 and bottom 86 surfaces. The base 74 has at least one aperture 88 from the top through to the bottom adjacent the base rear end 78. The base 74 has a shaft hole 90 from the top 84 through to the bottom 86. The base bottom surface 86 is adapted for attachment to the boat by means of three studs 92 and a clamping ring 94.

A shaft 96 extends between opposite upper 98 and lower 100 ends. The shaft 96 is mounted to the base 74 for rotation, and has threads 102 on the upper end 98.

A chainwheel 104 is mounted on the shaft 96 for rotation therewith. The chainwheel 104 has an outer periphery 105 and an annular groove 107 around the outer periphery 105. The chainwheel annular groove 107 is adapted to engage the rode 72 so as to pull the rode 72 during rotation of the chainwheel 104. The chainwheel 104 has an upper portion 106 and an opposite lower portion 108 spaced apart from the upper portion, the upper 106 and lower 108 portions are joined for rotation in unison. A sleeve 110 is disposed between the chainwheel upper 106 and lower 108 portions, to align the portions 106 and 108. The sleeve 110 is concentric with the upper 106 and lower 108 portions, and the shaft 96.

An upper clutch disk 112 is mounted on the shaft 96 and is keyed for rotation with the shaft 96. The upper clutch disk 112 frictionally engages the chainwheel upper portion 106 so as to transmit torque from the shaft 96 to the chainwheel 104. A lower clutch disk 114 is mounted on the shaft 96 and is keyed for rotation the shaft 96. The lower clutch disk 114 frictionally engages the chainwheel lower portion 108 so as to transmit torque from the shaft 96 to the chainwheel 104. A nut 116 threadingly engages the shaft upper end 98 for retaining the clutch disks 112 and 114 and the chainwheel 104 on the shaft. The nut 116 will also allow for adjusting the frictional engagement of the clutch disks 112 and 114 and the chainwheel 104 to allow slippage. This will preclude breakage of the rode 72 should the anchor become stuck and tension increases. Loosening the nut 116 allows the chainwheel 104 to turn freely, to drop anchor without using the motor drive.

A stripper plate 118 has a proximal end 120 encircling the innermost portion of the annular groove 107 and extending rearward to a distal end 122 attached to the base 74. The stripper plate 118 will transmit pulling forces from the rode 72 through the chainwheel 104, through the stripper plate 118 to the base 74. This will reduce radial forces on the shaft 96, and will strip the rode 72 from engagement with the chainwheel 104, if the rode becomes stuck.

A flexible retainer 124 extends between opposite left 126 and right 128 ends, and is attached to the windlass 70 adjacent the base front end 76. The retainer has a right trunnion 130 on the retainer right end 128. The right trunnion 130 extends between opposite upper 132 and lower 134 ends. The retainer 124 has a left trunnion 136 on the retainer left end 126. The left trunnion 136 extends between opposite upper 138 and lower 140 ends. The retainer 124 is disposed across the chainwheel annular groove 108, and serves to press the rode 72 into the chainwheel annular groove 108. This will ensure that the rode 72 is retained on the chainwheel 104, and will not ride up and out of the chainwheel 104 regardless of slack in the rode. The retainer 124 has a front surface 142 and an opposite rear surface 144. The retainer rear surface 144 has corrugations 146 for contact with the rode 72. A right pin 148 extends downward through the right trunnion 130. A left pin 150 extends downward through the left trunnion 136, to strengthen the trunnion.

A leaf spring 152 is mounted coextensively on the retainer 124. The leaf spring 152 extends between opposite left 154 and right 156 ends, and is for biasing the retainer 124 against the rode 72. The retainer 124 has a right pocket 158 adjacent the right end 128 for receiving the leaf spring right end 156. The retainer 124 has a left pocket 160 adjacent the left end 126 for receiving the leaf spring left end 154. The pockets 158 and 160 will hold the leaf spring 152 closely adjacent the retainer front surface 142, while allowing the leaf spring 152 to flex with the retainer 124.

A housing 162 extending between opposite front 164 and rear 166 ends, and between opposite left 168 and right 170 sides. The housing 162 has inner 172 and outer 174 surfaces. The housing 162 is attached to the base 74 by means of a single fastener 179. The housing 162 covers the chainwheel 104, the shaft upper end 98, and the retainer 124. The housing 162 is adapted to cover the rode 72 for safety. The housing 162 has an arcuate upper groove 165 on the inner surface 172 adjacent the front end 164. The upper groove 165 faces downward and extends across the housing 162 from the left side 168 to the right side 170.

Figure 39:
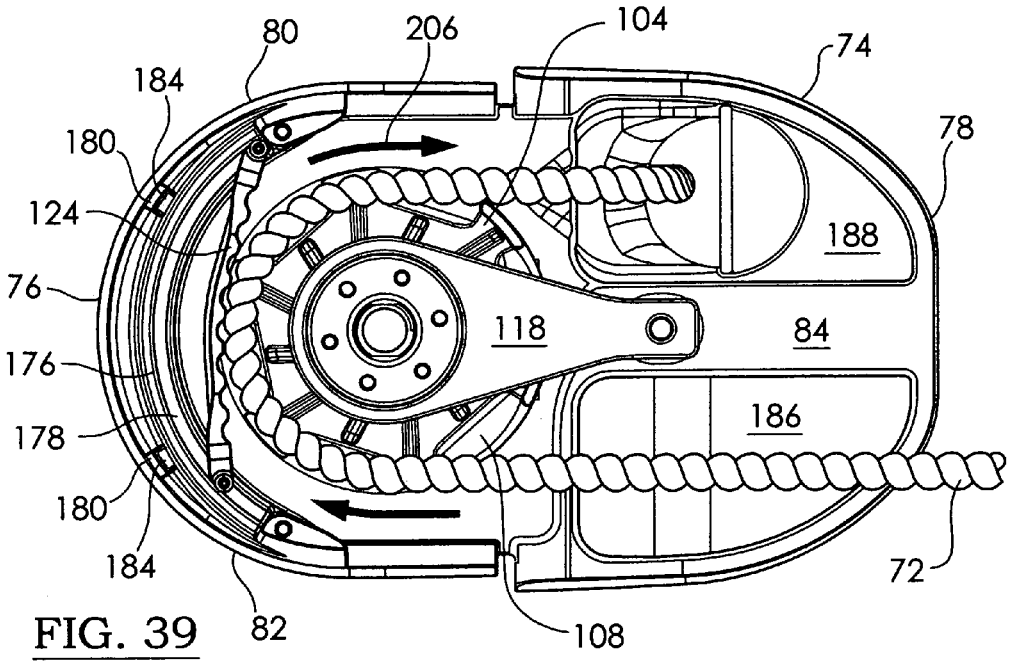
Figure 40:
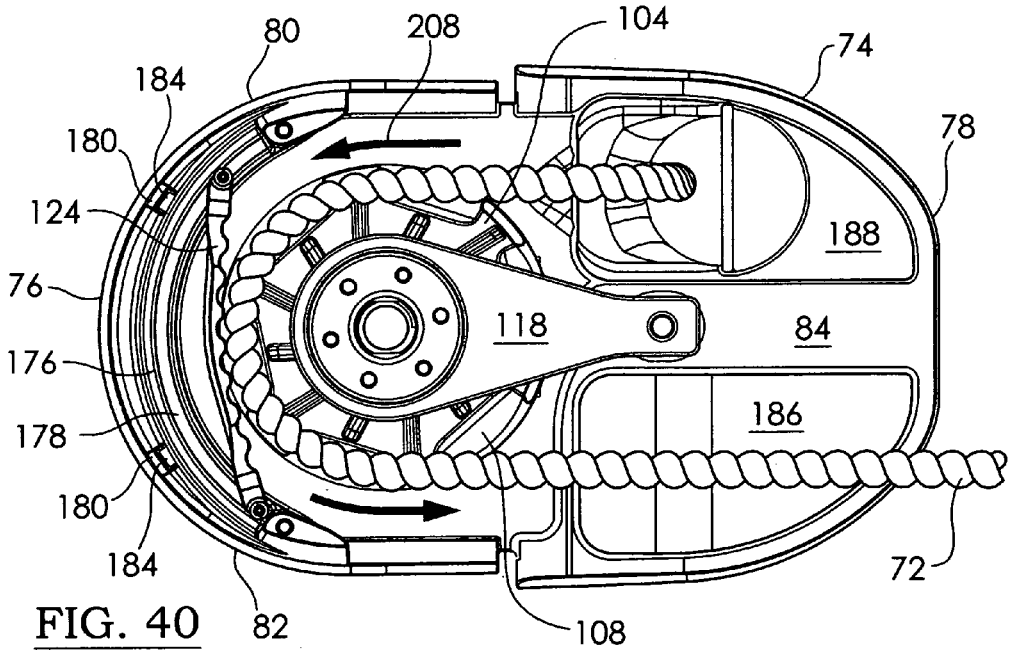
FIG. 40 is a top plan view of the windlass of FIG. 1, with the housing and chainwheel upper portion removed, showing the retainer and the rode winding out.

An arcuate member 176 extends across the housing 162 from the left side 168 to the right side 170. The arcuate member 176 has an arcuate lower groove 178 facing upward and extending across the housing 162 opposite and coextensive with the upper groove 165. The right 132 and left 138 trunnion upper ends are received in the upper groove 165. The right 134 and left 140 trunnion lower ends are received in the lower groove 178. This allows the trunnions 130 and 136 to pivot in the grooves 165 and 178 as the retainer 124 flexes. This also allows the trunnions 130 and 136 to slide in the grooves 165 and 178 toward the slack portion of the rode 72, so that the retainer 124 will conform closely to the rode 72 during rotation of the chainwheel in either direction. The rode 72 brushing across the corrugations 146 causes the retainer 124 to slide transversely in the grooves 165 and 178. This is especially important toward the slack portion of the rode, which tends to ride off the chainwheel. FIG. 39 shows the anchor rode 72 being hauled in to hoist the anchor, as indicated by arrows 206. The retainer 124 slides to one side, and is in contact with the slack portion of the rode 72. FIG. 40 shows the anchor rode 72 being let out to drop the anchor, as indicated by arrows 208. The retainer 124 slides to the opposite side, and is again in contact with the slack portion of the rode 72.

The base 74 has at least one, and preferably two, first key members 180 adjacent the base front end 76. The housing 162 has at least one, and preferably two, second key members 182 adjacent the front end 164. The arcuate member 176 has at least one, and preferably two, third key members 184 adjacent the housing front end 164. The first 180, second 182, and third 184 key members engage one another so as to align the base 74, the housing 162, and the arcuate member 176.

A wear plate 186 is attached to the base 74 adjacent the rear end 78, and is adapted for sliding contact with the rode 72. The wear plate 186 is made from a low friction, wear-resistant polymer.

A funnel 188 is provided, and has a mouth 190 facing forward, and a nozzle 192 extending downward and communicating with the mouth 190. The funnel 188 is mounted on the base aperture 88, and is for directing the rode 72 downward into the boat.

An upper bearing 200 is installed in the base 74, and supports the shaft upper end 98. A shaft support 202 extends downward from the base 74. A lower bearing 204 is installed in the shaft support 202 and supports the shaft lower end 100.

A motor drive 194 is attached to the shaft lower end 100 for rotating the shaft 96. The motor drive 194 typically has an electric motor 196 and a worm gear transmission 198.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST

Anchor Windlass for Boats

PART
NO. DESCRIPTION
70 windlass
72 anchor rode
74 base
76 base front
78 base rear
80 base left
82 base right
84 base top
86 base bottom

88 aperture
90 shaft hole
92 studs
94 clamping ring
96 shaft
98 shaft upper end
100 shaft lower end
102 threads
104 chainwheel
105 outer periphery
106 upper portion
107 annular groove
108 lower portion
110 sleeve
112 upper clutch disk
114 lower clutch disk
116 nut
118 stripper plate
120 stripper plate proximal end
122 stripper plate distal end
124 retainer
126 retainer left end
128 retainer right end
130 right trunnion
132 right trunnion upper end
134 right trunnion lower end
136 left trunnion
138 left trunnion upper end
140 left trunnion lower end
142 retainer front surface
144 retainer rear surface
146 corrugations
148 right pin
150 left pin
152 leaf spring
154 leaf spring left end
156 leaf spring right end
158 right pocket
160 left pocket
162 housing
164 housing front end
165 arcuate upper groove
166 housing rear end
168 housing left side
170 housing right side
172 housing inner surface
174 housing outer surface
176 arcuate member
178 arcuate lower groove
179 housing fastener
180 first key members
182 second key members
184 third key members
186 wear plate
188 funnel
190 mouth
192 nozzle
194 motor drive
196 electric motor
198 worm gear transmission
200 upper bearing
202 shaft support
204 lower bearing
206 arrow hoisting
208 arrow dropping The embodiments of the invention in which an exclusive property or privilege is claimed are defined as follows:

1. A windlass, for use in connection with a boat, an anchor, and a rode, the rode having a tensioned portion entering the windlass and a slack portion exiting the windlass, the windlass comprising:

a base extending between opposite front and rear ends, and between opposite left and right sides, and between opposite top and bottom surfaces, the base having at least one aperture from the top through to the bottom adjacent the base rear end, the base having a shaft hole from the top through to the bottom, the base bottom surface being adapted for attachment to the boat;

a shaft extending between opposite upper and lower ends, the shaft being mounted to the base for rotation, the shaft having threads on the upper end;

a chainwheel mounted on the shaft for rotation therewith, the chainwheel having an outer periphery and an annular groove around the outer periphery, the chainwheel annular groove being adapted to engage the rode so as to pull the rode during rotation of the chainwheel;

a retainer extending between opposite left and right ends, the retainer being flexible, the retainer having aright trunnion on the retainer right end, the right trunnion extending between opposite upper and lower ends, the retainer having a left trunnion on the retainer left end, the left trunnion extending between opposite upper and lower ends, the retainer being disposed across the chainwheel annular groove, for pressing the rode into the chainwheel annular groove so as to retain the rode on the chainwheel;

a housing extending between opposite front and rear ends, and between opposite left and right sides, the housing having inner and outer surfaces, the housing being attached to the base and covering the chainwheel, shaft upper end, and retainer, the housing being adapted to cover the rode for safety, the housing having an arcuate upper groove on the inner surface adjacent the front end, the upper groove facing downward and extending across the housing from the left side to the right side;

an arcuate member extending across the housing from the left side to the right side, the arcuate member having an arcuate lower groove facing upward and extending across the housing opposite and coextensive with the upper groove;

the right and left trunnion upper ends being received in the upper groove, the right and left trunnion lower ends being received in the lower groove, allowing the trunnions to pivot in the upper and lower grooves as the retainer flexes, and to slide in the upper and lower grooves toward the slack portion of the rode, so that the retainer will conform closely to the rode, especially toward the slack portion, during rotation of the chainwheel in either direction; and a motor drive attached to the shaft lower end for rotating the shaft.

2. The windlass of claim 1, further comprising a leaf spring mounted coextensively on the retainer, for biasing the retainer against the rode.

3. The windlass of claim 2, further comprising:

a right pin extending downward through the right trunnion, and a left pin extending downward through the left trunnion, to strengthen the trunnions;

the retainer having a front surface and an opposite rear surface, the retainer rear surface having corrugations for contact with the rode, so that the corrugations will cause the retainer to slide transversely in the upper and lower grooves toward the slack portion of the rode so as to preclude the slack portion of the rode from riding off the chainwheel;

the leaf spring extending between opposite left and right ends;

the retainer having a pocket adjacent the right end for receiving the leaf spring right end, the retainer having a pocket adjacent the left end for receiving the leaf spring left end, so as to hold the leaf spring closely adjacent the retainer front surface, while allowing the leaf spring to flex with the retainer.

4. The windlass of claim 1, further comprising:

the base having at least one first key member adjacent the base front end;

the housing having at least one second key member adjacent the front end; and the arcuate member having at least one third key member adjacent the housing front end, the first, second, and third key members engaging one another so as to align the base, the housing, and the arcuate member.

5. The windlass of claim 1, further comprising a funnel having a mouth facing forward, the funnel having a nozzle extending downward and communicating with the mouth, the funnel being mounted on the base aperture for directing the rode downward into the boat.

6. The windlass of claim 1, further comprising:

the chainwheel having an upper portion and an opposite lower portion, the upper and lower portions being joined for rotation in unison;

an upper clutch disk mounted on the shaft and keyed for rotation therewith, the upper clutch disk frictionally engaging the chainwheel upper portion so as to transmit torque from the shaft to the chainwheel;

a lower clutch disk mounted on the shaft and keyed for rotation therewith, the lower clutch disk frictionally engaging the chainwheel lower portion so as to transmit torque from the shaft to the chainwheel; and a nut threadingly engaging the shaft upper end for retaining the clutch disks and chainwheel on the shaft, and for adjusting the frictionally engaging of the clutch disks and the chainwheel to allow slippage, thereby precluding breakage of the rode.

7. The windlass of claim 6, further comprising:

a sleeve disposed between the chainwheel upper and lower portions, the sleeve being concentric with the shaft; and a stripper plate having a proximal end encircling the annular groove between the chainwheel upper and lower portions and extending rearward to a distal end attached to the base, so as to transmit pulling forces from the rode through the chainwheel, through the stripper plate to the base, thereby reducing radial forces on the shaft, and to strip the rode from engagement with the chainwheel.

8. The windlass of claim 1, further comprising a wear plate attached to the base adjacent the rear end and adapted for sliding contact with the rode, the wear plate being made from a low friction, wear-resistant polymer.

9. A windlass, for use in connection with a boat, an anchor, and a rode, the windlass comprising:

a base extending between opposite front and rear ends, and between opposite left and right sides, and between opposite top and bottom surfaces, the base having at least one aperture from the top through to the bottom adjacent the base rear end, the base having a shaft hole from the top through to the bottom, the base bottom surface being adapted for attachment to the boat;

a shaft extending between opposite upper and lower ends, the shaft being mounted to the base for rotation, the shaft having threads on the upper end;

a chainwheel mounted on the shaft for rotation therewith, the chainwheel having an outer periphery and an annular groove around the outer periphery, the chainwheel annular groove being adapted to engage the rode so as to pull the rode during rotation of the chainwheel;

a retainer extending between opposite left and right ends, the retainer being flexible, the retainer having a right trunnion on the retainer right end, the right trunnion extending between opposite upper and lower ends, the retainer having a left trunnion on the retainer left end, the left trunnion extending between opposite upper and lower ends, the retainer being disposed across the chainwheel annular groove, for pressing the rode into the chainwheel annular groove so as to retain the rode on the chainwheel;

a leaf spring mounted coextensively on the retainer, for biasing the retainer against the rode;

a housing extending between opposite front and rear ends, and between opposite left and right sides, the housing having inner and outer surfaces, the housing being attached to the base and covering the chainwheel, shaft upper end, and retainer, the housing being adapted to cover the rode for safety, the housing having an arcuate upper groove on the inner surface adjacent the front end, the upper groove facing downward and extending across the housing from the left side to the right side;

an arcuate member extending across the housing from the left side to the right side, the arcuate member having an arcuate lower groove facing upward and extending across the housing opposite and coextensive with the upper groove;

the right and left trunnion upper ends being received in the upper groove, the right and left trunnion lower ends being received in the lower groove, allowing the trunnions to pivot in the upper and lower grooves as the retainer flexes, and to slide in the upper and lower grooves toward the slack portion of the rode, so that the retainer will conform closely to the rode, especially toward the slack portion, during rotation of the chainwheel in either direction; and a motor drive attached to the shaft lower end for rotating the shaft.

10. The windlass of claim 9, further comprising:

a right pin extending downward through the right trunnion, and a left pin extending downward through the left trunnion, to strengthen the trunnions;

the retainer having a front surface and an opposite rear surface, the retainer rear surface having corrugations for contact with the rode, so that the corrugations will cause the retainer to slide transversely in the upper and lower grooves toward the slack portion of the rode so as to preclude the slack portion of the rode from riding off the chainwheel;

the leaf spring extending between opposite left and right ends;

the retainer having a pocket adjacent the right end for receiving the leaf spring right end, the retainer having a pocket adjacent the left end for receiving the leaf spring left end, so as to hold the leaf spring closely adjacent the retainer front surface, while allowing the leaf spring to flex with the retainer.

11. The windlass of claim 9, further comprising:

the base having at least one first key member adjacent the base front end;

the housing having at least one second key member adjacent the front end; and the arcuate member having at least one third key member adjacent the housing front end, the first, second, and third key members engaging one another so as to align the base, the housing, and the arcuate member.

12. The windlass of claim 9, further comprising a funnel having a mouth facing forward, the funnel having a nozzle extending downward and communicating with the mouth, the funnel being mounted on the base aperture for directing the rode downward into the boat.

13. The windlass of claim 9, further comprising:

the chainwheel having an upper portion and an opposite lower portion, the upper and lower portions being joined for rotation in unison;

an upper clutch disk mounted on the shaft and keyed for rotation therewith, the upper clutch disk frictionally engaging the chainwheel upper portion so as to transmit torque from the shaft to the chainwheel;

a lower clutch disk mounted on the shaft and keyed for rotation therewith, the lower clutch disk frictionally engaging the chainwheel lower portion so as to transmit torque from the shaft to the chainwheel; and a nut threadingly engaging the shaft upper end for retaining the clutch disks and chainwheel on the shaft, and for adjusting the frictionally engaging of the clutch disks and the chainwheel to allow slippage, thereby precluding breakage of the rode.

14. The windlass of claim 13, further comprising:

a sleeve disposed between the chainwheel upper and lower portions, the sleeve being concentric with the shaft; and a stripper plate having a proximal end encircling the annular groove between the chainwheel upper and lower portions and extending rearward to a distal end attached to the base, so as to transmit pulling forces from the rode through the chainwheel, through the stripper plate to the base, thereby reducing radial forces on the shaft, and to strip the rode from engagement with the chainwheel.

15. The windlass of claim 9, further comprising a wear plate attached to the base adjacent the rear end and adapted for sliding contact with the rode, the wear plate being made from a low friction, wear-resistant polymer.

16. A windlass, for use in connection with a boat, an anchor, and a rode, the windlass comprising:

a base extending between opposite front and rear ends, and between opposite left and right sides, and between opposite top and bottom surfaces, the base having at least one aperture from the top through to the bottom adjacent the base rear end, the base having a shaft hole from the top through to the bottom, the base bottom surface being adapted for attachment to the boat;

a shaft extending between opposite upper and lower ends, the shaft being mounted to the base for rotation, the shaft having threads on the upper end;

a chainwheel mounted on the shaft for rotation therewith, the chainwheel having an outer periphery and an annular groove around the outer periphery, the chainwheel annular groove being adapted to engage the rode so as to pull the rode during rotation of the chainwheel;

a retainer extending between opposite left and right ends, the retainer being flexible, the retainer having a right trunnion on the retainer right end, the right trunnion extending between opposite upper and lower ends, the retainer having a left trunnion on the retainer left end, the left trunnion extending between opposite upper and lower ends, the retainer being disposed across the chainwheel annular groove, the retainer being adapted to conform closely to the rode, for pressing the rode into the chainwheel annular groove so as to retain the rode on the chainwheel, the retainer having a front surface and an opposite rear surface, the retainer rear surface having corrugations for contact with the rode;

a right pin extending downward through the right trunnion, and a left pin extending downward through the left trunnion, to strengthen the trunnions;

a leaf spring mounted coextensively on the retainer, the leaf spring extending between opposite left and right ends, for biasing the retainer against the rode, the retainer having a pocket adjacent the right end for receiving the leaf spring right end, the retainer having a pocket adjacent the left end for receiving the leaf spring left end, so as to hold the leaf spring closely adjacent the retainer front surface, while allowing the leaf spring to flex with the retainer;

a housing extending between opposite front and rear ends, and between opposite left and right sides, the housing having inner and outer surfaces, the housing being attached to the base and covering the chainwheel, shaft upper end, and retainer, the housing being adapted to cover the rode for safety, the housing having an arcuate upper groove on the inner surface adjacent the front end, the upper groove facing downward and extending across the housing from the left side to the right side;

an arcuate member extending across the housing from the left side to the right side, the arcuate member having an arcuate lower groove facing upward and extending across the housing opposite and coextensive with the upper groove;

the right and left trunnion upper ends being received in the upper groove, the right and left trunnion lower ends being received in the lower groove, allowing the trunnions to pivot in the grooves as the retainer flexes, and to slide in the grooves, so that the corrugations will cause the retainer to slide transversely in the upper and lower grooves toward the slack portion of the rode to preclude the slack portion of the rode from riding off the chainwheel during rotation of the chainwheel in either direction; and a motor drive attached to the shaft lower end for rotating the shaft.

17. The windlass of claim 16, further comprising:

the base having at least one first key member adjacent the base front end;

the housing having at least one second key member adjacent the front end; and the arcuate member having at least one third key member adjacent the housing front end, the first, second, and third key members engaging one another so as to align the base, the housing, and the arcuate member.

18. The windlass of claim 16, further comprising a funnel having a mouth facing forward, the funnel having a nozzle extending downward and communicating with the mouth, the funnel being mounted on the base aperture for directing the rode downward into the boat.

19. The windlass of claim 16, further comprising:

the chainwheel having an upper portion and an opposite lower portion spaced apart from the upper portion, the upper and lower portions being joined for rotation in unison;

a sleeve disposed between the chainwheel upper and lower portions, the sleeve being concentric with the shaft;

an upper clutch disk mounted on the shaft and keyed for rotation therewith, the upper clutch disk frictionally engaging the chainwheel upper portion so as to transmit torque from the shaft to the chainwheel;

a lower clutch disk mounted on the shaft and keyed for rotation therewith, the lower clutch disk frictionally engaging the chainwheel lower portion so as to transmit torque from the shaft to the chainwheel;

a nut threadingly engaging the shaft upper end for retaining the clutch disks and chainwheel on the shaft, and for adjusting the frictionally engaging of the clutch disks and the chainwheel to allow slippage, thereby precluding breakage of the rode; and a stripper plate having a proximal end encircling the annular groove and extending rearward to a distal end attached to the base, so as to transmit pulling forces from the rode through the chainwheel, through the stripper plate to the base, thereby reducing radial forces on the shaft, and to strip the rode from engagement with the chainwheel.

* * * * *